United States Patent [19]

Harada et al.

[11] Patent Number: 4,750,715

[45] Date of Patent: Jun. 14, 1988

[54] APPARATUS FOR COOLING STEEL BELT

[75] Inventors: Masahiro Harada; Hajime Okioa; Kaneaki Hyodo, all of Hiroshima, Japan

[73] Assignee: Mitsubishi Jukogyo Kabushiki Kaisha, Tokyo, Japan

[21] Appl. No.: 869,900

[22] Filed: Jun. 3, 1986

[30] Foreign Application Priority Data

Jul. 9, 1985 [JP] Japan ..... 60-149162
Jul. 9, 1985 [JP] Japan ..... 60-149163

[51] Int. Cl.[4] ..... C21D 1/62

[52] U.S. Cl. ..... 266/102; 266/111; 311/156

[58] Field of Search ..... 34/156, 155; 266/102, 266/103, 111; 226/196; 148/153, 155, 156

[56] References Cited

U.S. PATENT DOCUMENTS 3,097,971 7/1963 Carlisle et al. ..... 34/156
3,962,799 6/1976 Lapointe et al. ..... 34/54
4,501,553 2/1985 Imose et al. ..... 432/59

FOREIGN PATENT DOCUMENTS 208027 11/1984 Japan ..... 266/111

*Primary Examiner*—Christopher W. Brody
*Attorney, Agent, or Firm*—Wenderoth, Lind & Ponack

[57] ABSTRACT

A steel belt cooling apparatus is provided on both sides of a running steel belt. Each cooling apparatus has a gas cushion type nozzle essentially consisting of two slit nozzles which extend in the lateral direction of the steel belt with each nozzle head inclined inwardly toward the other and a flat plate between the slit nozzles. On the flat plate are a plurality of ribs extending from the slit nozzle on the upstream side to the slit nozzle on the downstream side and arranged in parallel across the width of the steel belt. The ribs may be provided such that the height of the tips of the ribs may be the same as the height of the tips of the gas cushion nozzle.

2 Claims, 5 Drawing Sheets

APPARATUS FOR COOLING STEEL BELT

BACKGROUND OF THE INVENTION

The present invention relates to an improved cooling nozzle for a gas jetting system steel belt cooling apparatus.

Jetting gas from a slit nozzle is known as a method of cooling a heated steel belt in continuous annealing equipment or a continuous heat treatment line. In such a jetting type cooling apparatus, as shown in FIG. 7, a steel belt 1 which is traveling in the direction indicated by the arrow is cooled by jetting cooling gas (e.g. He-Ne mixed gas) supplied by blowers 2*a* and 2*b* from the gas jet nozzles of headers 3*a*, 3*b*, respectively, onto both surfaces of the steel belt 1. The gas jet nozzles of the headers 3*a*, 3*b*, as shown in FIG. 7, comprise straight nozzles 4*a*, 4*b* which are perpendicular to the steel belt surfaces, and gas cushion type nozzles 5*a*, 5*b* consisting of two pairs of slit nozzles 8*a*, 8*a*; 8*b*, 8*b* which face the steel belt 1 with their nozzle heads inclined inwardly and facing each other and flat plates 6*a*, 6*b* for blocking the gap between the respective pairs of slit nozzles 8*a*, 8*a*; 8*b*, 8*b*.

Among the above-described cooling nozzles, the straight nozzle 4*a*, 4*b* play the major role in cooling. The gas cushion type nozzles, which have a slightly inferior cooling capacity in comparison with the straight nozzles, form an almost closed space in relation to the flow of the gas jetted in the area surrounded by the flat plates (hereinunder referred to as "pressure plates") and the steel belt surfaces, whereby a reverse gas flow is formed and the pressure in the space is maintained at a high pressure. Therefore, the gas cushion type nozzles when operated push back the steel belt (hereinunder referred to "gas cushion function") when a deformed steel belt or a steel belt drooping due to a change in tensile strength approaches the nozzles. This gas cushion function is most effectively exercised when the inclination angle $\theta$ of the jet head of the slit nozzle is 30 to 60 degrees.

In such gas jet type cooling equipment, a conventional gas cushion type nozzle is effective for preventing contact between the steel belt and the nozzle if the steel belt when approaching the nozzle is parallel thereto. Actually, however, the steel belt approaches the nozzle obliquely with respect to its widthwise direction, or in a concave or convex form, so that the gas cushion nozzle cannot display the above-described gas cushion function, and the steel belt sometimes comes into contact with the nozzle, thereby receiving a scratch. This is because the gas from the gas cushion nozzle does not flow reversely to the running direction of the steel belt, but leaks in the lateral direction of the steel belt, thereby cancelling the repulsive force imparted by the nozzle to the steel belt (gas cushion effect) which is caused by the reverse gas flow.

SUMMARY OF THE INVENTION

Accordingly, it is an object of the present invention to provide a cooling apparatus which enables the flow of the gas from a gas cushion nozzle to be opposite to the direction in which a steel belt travels irrespective of the manner in which a steel belt approaches the nozzle.

To achieve this aim, a cooling apparatus according to the present invention is provided on both sides of a running steel belt. Each cooling apparatus is comprised of a gas cushion type nozzle essentially consisting of two slit nozzles which extend in the lateral direction of the steel belt with each nozzle head inclined inwardly toward each other and a flat plate provided between the slit nozzles. On the flat plate are a plurality of ribs extending from the slit nozzle on the upstream side to the slit nozzle on the downstream side and arranged in parallel across the width of the steel belt. The ribs may be provided such that the height of the tips of the ribs may be the same as the height of the tips of the gas cushion nozzles.

In this way, by providing a plurality of protruding ribs which extend in the direction in which the steel belt travels on the pressure plate between the slit nozzles and which are parallel to one another across the width of the steel belt, the distance between the ribs and the steel belt is very short regardless of the manner in which the steel belt approaches the nozzle. As a result, the gas which would tend to leak in the lateral direction of the steel belt is subjected to a large fluid resistance and does not readily leak by the virtue of what is called a labyrinth effect. Therefore, the gas is forced to flow opposite to the direction in which the steel belt travels; thus the intrinsic gas cushion function is displayed.

The above and other objects, features and advantages of the present invention will become clear from the following description of the preferred embodiments thereof, taken in conjunction with the accompanying drawings.

DESCRIPTION OF THE PREFERRED EMBODIMENTS

Embodiments of the present invention will be described hereinunder with reference to the accompanying drawings.

Figure 1:
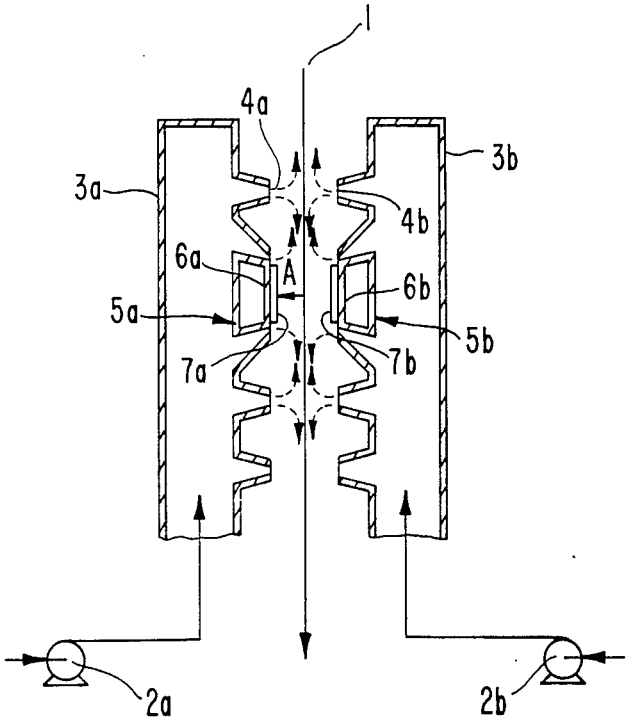
FIG. 1 is a sectional view of the main part of an emobodiment of an apparatus for cooling a steel belt according to the present invention, schematically showing the structure thereof.
Figure 2:
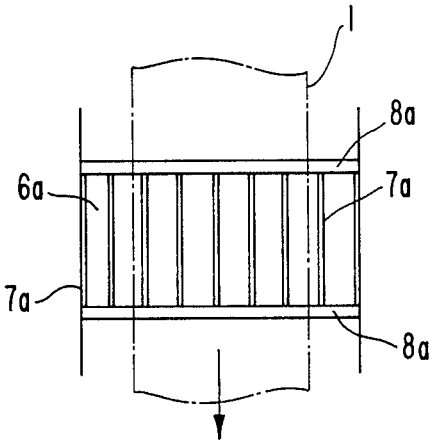
FIG. 2 shows the gas cushion nozzle portion in FIG. 1, viewed in the direction indicated by the arrow A.
Figure 3:
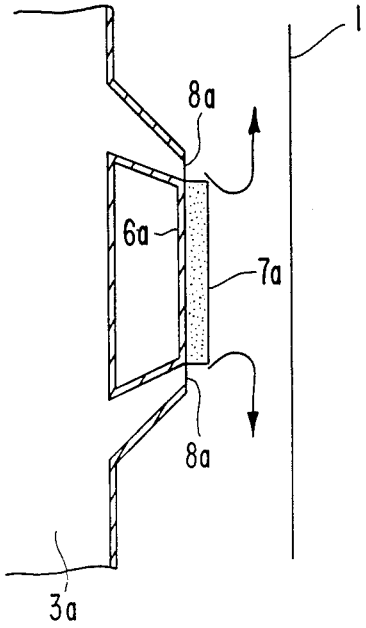
FIG. 3 is a sectional view of the gas cushion nozzle portion shown in FIG. 2.
Figure 4:
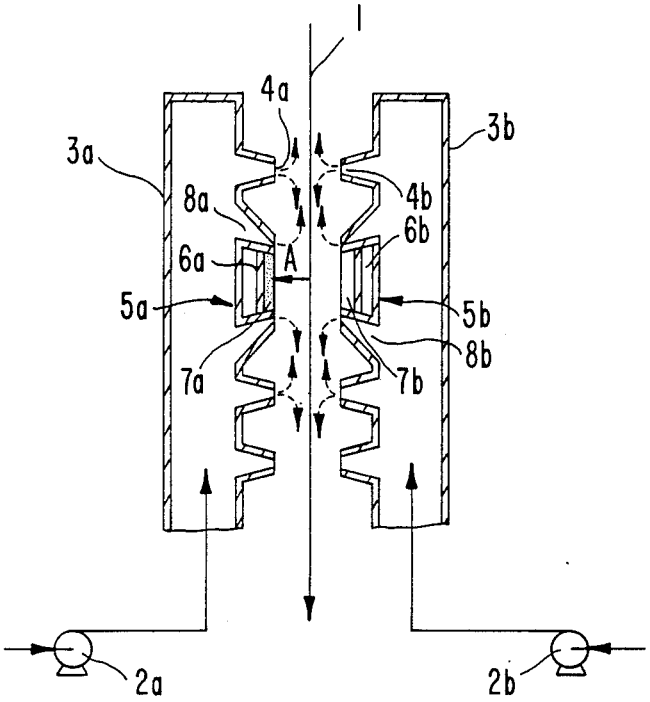
FIG. 4 is a sectional view of the main part of another embodiment of an apparatus for cooling a steel belt according to the present invention, schematically showing the structure thereof.
Figure 5:
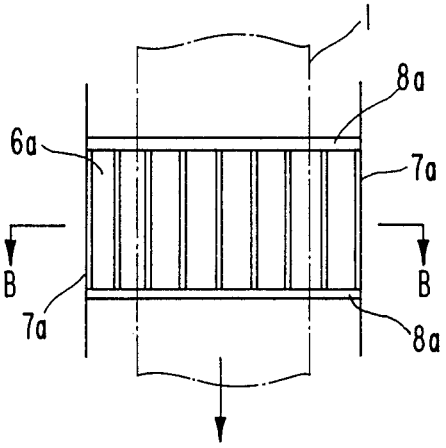
FIG. 5 shows the gas cushion nozzle portion in FIG. 4, viewed in the direction indicated by the arrow A.
Figure 6:
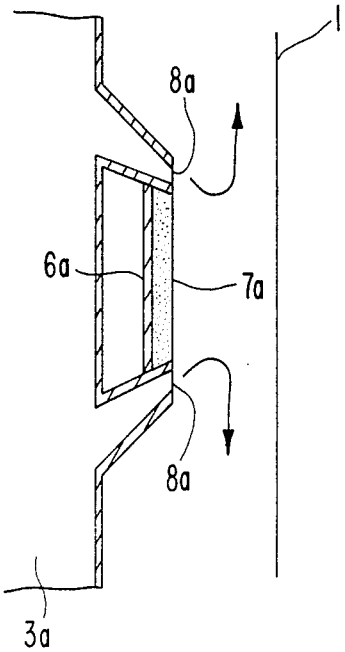
FIG. 6 is a sectional view of the gas cushion nozzle portion shown in FIG. 5.
Figure 7:
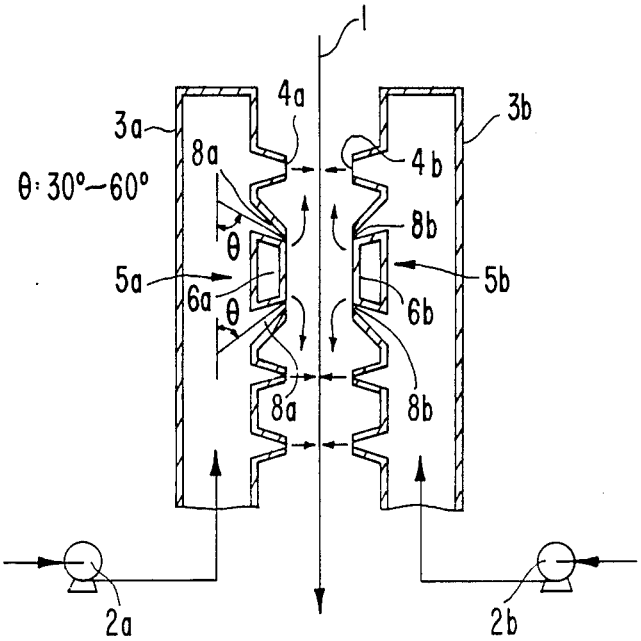
FIG. 7 is a sectional view of the main part of a conventional apparatus for cooling a steel belt.

FIG. 1 is a sectional side elevational view of a gas jetting system steel belt cooling apparatus; FIG. 2 is an elevational view of the gas cushion nozzle portion of the apparatus shown in FIG. 1, viewed in the direction indicated by the arrow A; and FIG. 3 is an enlarged view of the gas cushion nozzle portion of the apparatus shown in FIG. 1. FIG. 4 is a sectional side elevational view of another gas jetting system steel belt cooling apparatus; FIG. 5 is an elevational view of the gas cushion nozzle portion of the apparatus shown in FIG. 4, viewed in the direction indicated by the arrow A; and FIG. 6 is an enlarged view of the gas cushion portion of the apparatus shown in FIG. 4.

In these drawings, the referential numeral 1 denotes a steel belt which has been heated or heated and soaked to a temperature of approximately 700° C. to 800° C. in a continuous annealing furnace (not shown) and which travels in the direction indicated by the arrow. A cooling agent apparatus is used for cooling the steel belt 1 to a temperature of approximately 400° C. using $H_2$—$N_2$ mixed cooling gas.

The reference numerals 2*a*, 2*b* denote blowers for supplying $H_2$—$N_2$ mixed cooling gas, numerals, 3*a*, 3*b* denote headers, numerals 4*a*, 4*b* denote ordinary straight type nozzles, numerals 5*a*, 5*b* denote gas cushion mozzles, and numerals 6*a*, 6*b* denotes pressure plates. A multiplicity of ribs 7*a*, 7*b* are provided on the pressure plates 6*a*, 6*b*, and are spaced across the width thereof extending parallel to one another in the direction in which the steel plate 1 travels so as to protrude from the pressure plates toward the steel belt 1. The reference numeral 8*a* in FIGS. 2 and 5, each of which shows the gas cushion nozzle in the elevational view, denotes a slit nozzle from which gas jets.

As is obvious from FIG. 2, as the steel belt 1 approaches the ribs 7, the throat opening in the lateral direction is reduced and the resistance of the flow increases, so that the gas which jets from the slit nozzles which would tend to leak in the lateral direction of the steel belt can not easily leak in that direction and, as a result, the gas is forced to flow in the direction in which the steel belt travels. In other words, the gas flows as a reverse flow and what is called gas cushion effect, that is intrinsic to the gas cushion nozzle, is easily produced. Furthermore, since a plurality of such ribs are provided across the width of the steel belt and in parallel to one another, the gas cushion effect is produced between each pair of adjacent ribs when the steel plate approaches the nozzle, so that even if the width of the steel belt varies, the effect for precluding the possibility of steel belt coming into contact with the nozzle is not reduced.

Generally, the steel belt travels in the central portion of the space between the nozzles which are opposed to one another, and therefore the provision of the ribs do not impair the cooling effect intrinsic to the nozzles.

Such a gas cushion effect is produced not only in vertical type annealing equipment in which the steel belt travels vertically, as shown in FIG. 1, but also in horizontal type annealing equipment in which a steel belt travels horizontally.

As described above, the apparatus for cooling a steel belt according to the present invention is provided with a plurality of ribs extending to one another on the pressure plate between the slit nozzles. The ribs extend in the direction in which the steel belt travels, and the tips of the ribs are level with the gas cushion nozzle. As a result the apparatus according to the present invention brings about the following advantages.

(1) Since a steel belt does not readily come into contact with the nozzle, there is no danger of producing a scratch on the surface of the steel belt.

(2) It is possible to shorten the distance between the nozzles between which the steel belt is disposed and, hence, to increase the cooling effect.

(3) The advantage described in No. (2) leads to realization of a compact equipment.

While there has been describe what are at present considered to be preferred embodiments of the invention, it will be understood that various modifications may be made thereto, and it is intended that the appended claims cover all such modifications as fall within the true spirit and scope of the invention.

What is claimed is:

1. In an apparatus for cooling a travelling steel belt, the steel belt travelling between the past two of said apparatuses each of which faces a respective surface of the belt, and each said apparatus including a gas cushion nozzle having two slit nozzles extending in a direction across the width of the belt as the belt travels therepast for jetting gas to repel the belt as it travels, each of the two slit nozzles being inclined toward the other, and a flat plate extending between said two nozzles, the improvement comprising:

a plurality of parallel ribs mounted to said flat plate, each of said ribs extending from one of the two nozzles to the other of the two nozzles, and said plurality of ribs spaced from one another on the flat plate in said direction, the ribs for preventing the gas jetting from the two slit nozzles from flowing in said direction thereby ensuring that the belt is sufficiently repelled by the gas such that the belt does not contact the slit nozzles as it travels past the apparatus.

2. The improved apparatus as claimed in claim 1, wherein edges of the ribs that face the belt and tips of the respective gas cushion nozzles that face the belt all lie in a common place.

* * * * *